United States Patent [19]

Spitsbergen

[11] Patent Number: 4,513,898

[45] Date of Patent: Apr. 30, 1985

[54] WEB LOOP CONTROL APPARATUS AND METHOD

[75] Inventor: Merlin D. Spitsbergen, Rochester, Mich.

[73] Assignee: Centronics Data Computer Corp., Hudson, N.H.

[21] Appl. No.: 360,945

[22] Filed: Mar. 22, 1982

[51] Int. Cl.[3] ..... B65H 25/04

[52] U.S. Cl. ..... 226/44; 226/25; 226/45; 242/45; 242/75.52

[58] Field of Search ..... 226/25, 44, 45; 242/45, 242/75.52

[56] References Cited

U.S. PATENT DOCUMENTS

| | | | |
|---|---|---|---|
| 3,322,315 | 5/1967 | Eberlin | 226/44 |
| 3,323,700 | 6/1967 | Epstein et al. | 226/17 |
| 3,326,436 | 6/1967 | Huck | 226/25 |
| 3,368,726 | 2/1968 | Funk et al. | 226/17 |
| 3,452,853 | 7/1969 | Mabon | 197/133 |
| 3,547,369 | 12/1970 | Potucek | 242/75.52 |
| 3,584,805 | 6/1971 | Lee | 242/75.52 X |
| 3,587,959 | 6/1971 | Glover | 226/43 |
| 3,680,753 | 8/1972 | Shaw-Stewart | 226/25 |
| 3,731,890 | 5/1973 | Ruoff et al. | 22/75.52 X |
| 3,803,628 | 4/1974 | Van Brimer et al. | 346/1 |
| 3,807,613 | 4/1974 | Holm | 226/42 |
| 3,873,012 | 3/1975 | Wick et al. | 226/44 |
| 3,905,533 | 9/1975 | Corse | 226/44 |
| 3,912,145 | 10/1975 | Meihofer | 226/44 |
| 3,949,856 | 4/1976 | Ulber et al. | 197/133 R |
| 4,025,025 | 5/1977 | Bartel et al. | 226/33 |
| 4,033,492 | 7/1977 | Imai | 226/25 |
| 4,047,085 | 9/1977 | Ollendick | 318/601 |
| 4,050,564 | 9/1977 | Cormichael et al. | 197/1 R |
| 4,091,913 | 5/1978 | Ku et al. | 400/124 |

*Primary Examiner*—John Petrakes

*Attorney, Agent, or Firm*—Henry D. Pahl, Jr.

[57] ABSTRACT

A web loop control system has first and second roller stations and a web loop disposed therebetween. A dancer arm is biased into engagement with the web loop to maintain tension therein. An optical code disk is secured for rotation with the dancer arm and an optical sensing means cooperates with the code disk to generate dancer arm position information which is relayed to the motor control system to maintain a desired web loop length during both drive and stop modes. The invention as applied to a printer for serialized forms utilizes the dancer arm code disc/optical sensing means combination to insure that a between-forms perforation is present at the fuser roller nip when the system is at rest. The serialized form printing system also provides for controlled acceleration and deceleration between operating speed and a dead stop within $\frac{3}{8}$ inch of form length. Acceleration and deceleration are closely controlled to prevent jarring or excessive acceleration of the web loop. A motor control system is employed which utilizes an error signal summed with a rate damping signal generated from an optical code disk to provide stable motor control.

17 Claims, 4 Drawing Figures

Fig. 2
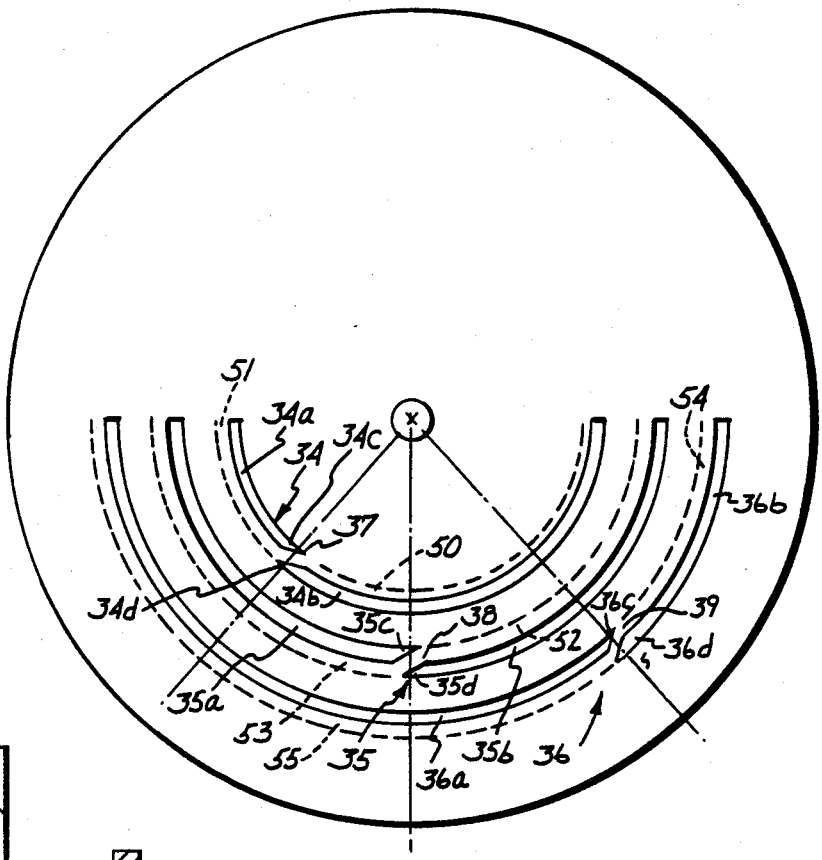
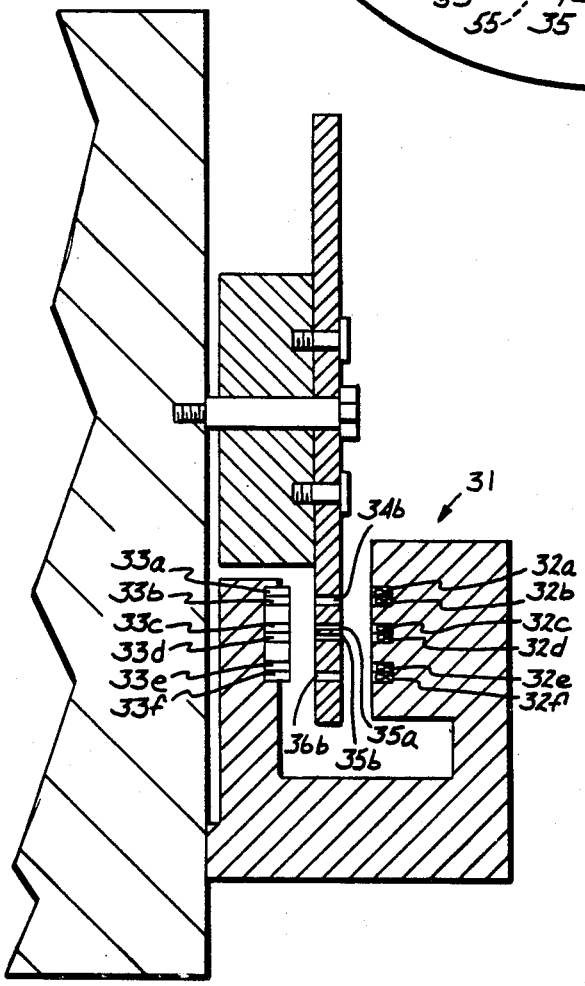
Fig. 3

WEB LOOP CONTROL APPARATUS AND METHOD

BACKGROUND

The invention pertains to web feeding apparatus, and more particularly, to those wherein a controlled web loop is provided between adjacent roller stations. See, for example, U.S. Pat. Nos. 3,912,145; 3,807,613; 3,322,315; 3,680,753; 3,905,533; 3,587,959; and 3,326,436.

Typically, the web loop is provided together with a dancer member biased into engagement with the web loop to maintain tension therein. In order to maintain desired tension in the web loop, a rotary transducer means has been coupled to the dancer member to indicate whether the tension is too great or too little. The signal from the transducer has been employed to control the drive means of the web feeding system to ensure proper web tensioning. The prior art devices have typically employed a potentiometer or other electromechanical means as the rotary transducer. See, for example, U.S. Pat. Nos. 3,912,145; 3,807,613; 3,322,315; 3,680,753; and 3,905,533.

A problem with such electromechanical means is their susceptibility to wear and the generation of noise.

Other systems have attempted to synchronize the web flow speed at the various stations by employing electromechanical tachometer generators at such stations in order to determine the various station motor speeds to synchronize them. Wear and noise problems are also associated with these electromechanical devices. U.S. Pat. No. 3,452,853 shows the use of an electromechanical tachometer generator.

Still other systems have employed optical sensing means reading directly on the paper web in order to determine the speed thereof and control the same as necessary. The use of such optical sensing means requires the presence of reference marks on the paper web. See, for example, U.S. Pat. Nos. 3,326,436; 3,949,856; 3,323,700; 3,368,726; 4,025,025; and 4,047,085.

Where the system involved is a printer for serialized forms, typically a transfer station will transfer toner particles to the paper web followed by a fuser station which employs a combination of heat and pressure to fix the toner to the paper. It is often necessary, for various reasons, to stop the paper web during a run. A desirable feature of the printer is the ability to stop and start between adjacent forms without losing a form in sequence. Printing is conventionally not permitted in an area within one-half inch of the between-forms perforations. Consequently, the paper motion control system must cause the paper to accelerate and decelerate within one-half inch distance.

In addition, when the paper web is stopped at the fuser station, it is important that it be stopped at a between-forms perforation in the "nip" or interference area between the pressure roller and the heater roller. If this is not done, the toner on the paper will become overheated and smear.

During a paper stop cycle, the toner deposited on the web loop between the transfer station and fuser station is held to the paper by a decaying electrostatic force. If this paper loop is jarred or excessively accelerated at start-up, the toner may be displaced. Consequently, there is a need for a system which provides smooth and controlled acceleration and deceleration of the paper loop.

There is, therefore, a need for a web feeding system which accomplishes all the foregoing objectives and overcomes the various shortcomings of the prior art set forth above.

SUMMARY

The present invention overcomes the shortcomings of the prior art and accomplishes the various objectives set forth, first, by providing an optically sensed dancer arm, the output of which is used to control the motor drives of the web feeding device. The use of an optical transducer in combination with a novel code disk to sense dancer arm orientation and generate dancer arm position information eliminates the need for potentiometers and like electromechanical devices.

The need for electromechanical tachometer generators for motor control is eliminated by the provision of optical tachometers and cooperating code discs fixed for rotation with the station drive motors. The use of such code discs also eliminates the need for marking and reading the paper web itself.

The invention as applied to printers for serialized forms in particular, provides a system for ensuring that the web is always stopped with a between-forms perforation at the fuser nip. The system also provides for controlled, steady acceleration and deceleration of the paper loop within the distance limitations required.

It is, therefore, an object of the present invention to provide an improved web feeding system.

It is a further object to provide a web feeding system in which a dancer arm is used to control web loop length and web tension in a desired manner.

It is a further object to provide a web feeding system in which the position of the dancer arm is optically sensed to generate dancer arm position information which is transmitted to system motor drives to achieve desired web loop conditions.

It is a further object to provide a web loop tensioning system in which the need for potentiometers and electromechanical tachometer generators is eliminated.

Yet another object is the provision of a web loop printer system for printing serialized forms which accommodates forms of all sizes and ensures that the printer will stop only with a between-forms perforation at the fuser roller nip.

A still further object is to provide a printer for serialized forms which provides for controlled and smooth acceleration and deceleration of the web loop between operating velocity and a dead stop position within a very short distance, typically on the order of $\frac{3}{8}$ inch to $\frac{1}{2}$ inch of form length.

It is a still further object to provide an improved motor control system wherein the system error signals are summed with rate damping signals generated from optical code disks fixed for rotation with the system motors to provide stable motor control.

These and other objects, advantages and novel features of the present invention will become apparent from the following detailed description of the invention taken in conjunction with the accompanying drawings.

DESCRIPTION OF THE DRAWINGS

FIG. 2 is an elevational view of the dancer arm code disk of the present invention.

FIG. 3 is a cross-sectional view taken along line 3—3 of FIG. 1 showing the dancer arm optical transducer structure of the present invention.

DESCRIPTION OF THE PREFERRED EMBODIMENT

Figure 1:
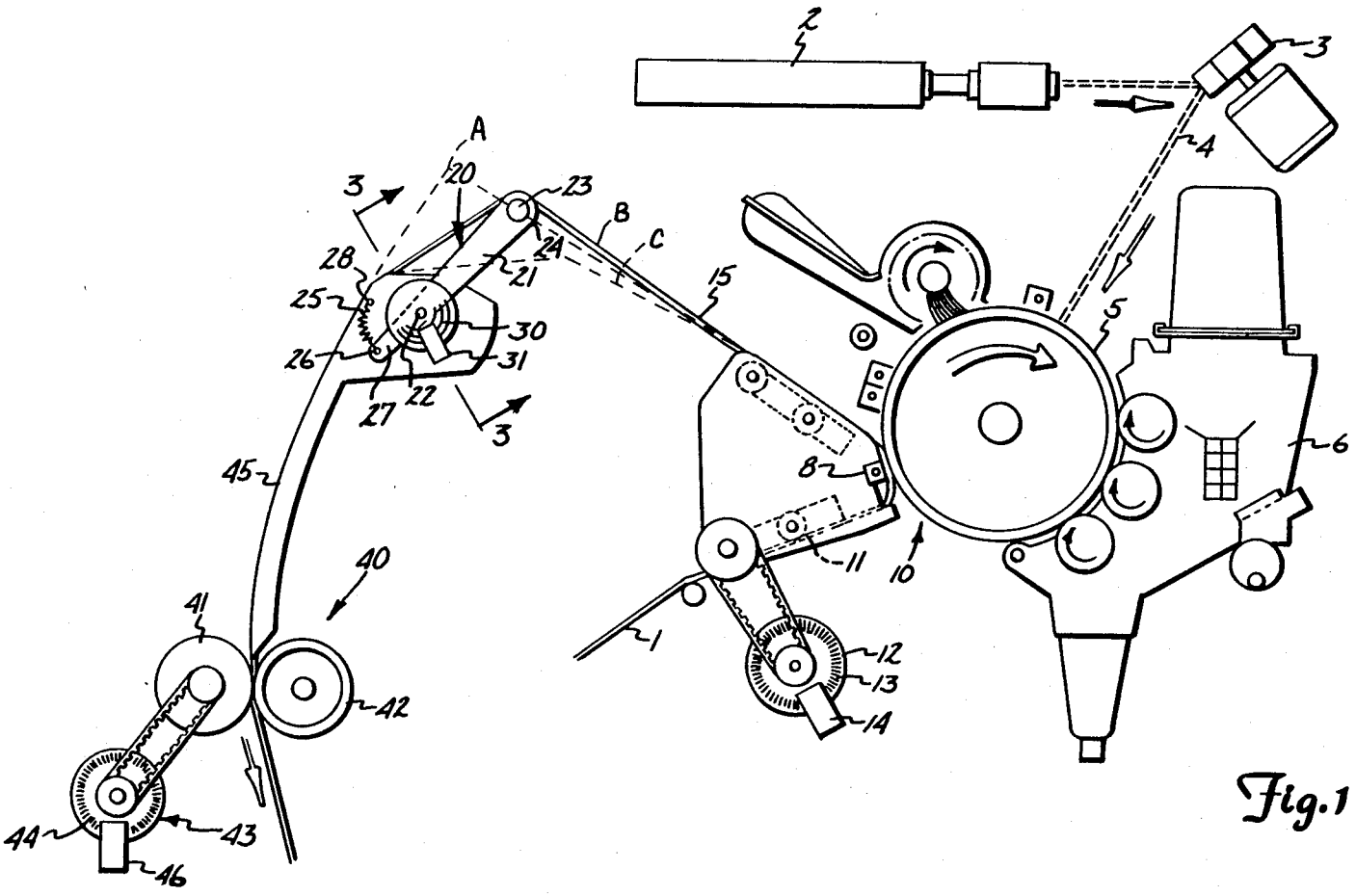
FIG. 1 is an elevational view showing the environment of the presently preferred embodiment of the invention.

FIG. 1 shows the environment of the presently preferred embodiment of the invention. Note that while the embodiment disclosed relates to a printer utilizing the laser electrophotographic process, the teachings of the invention are not limited to printers, and are applicable to various types of web tension control systems and to strand tension control systems as well.

In FIG. 1, the web 1, here paper, is fed from a source (not shown) into the transfer station 10, over the dancer arm 20 and through the fuser station 40 to a subsequent stage of the system.

In a laser controlled xerographic printer, the laser 2 is the source of monochromatic coherent light. As the scanner mirror 3 rotates, the laser beam 4 is swept across a photoconductive drum 5. The surface of the photoconductive drum 5 has been erased, cleaned and recharged earlier in the cycle, and at the time of laser exposure, it has a high voltage uniform charge on it. As the high intensity dot from the laser beam 4 is swept across the drum 5, the light energy from the beam discharges the drum's surface. The laser beam 4 is modulated by the data source as it is swept across the drum 5, and the modulated dot provides a discharge pattern across the drum in accordance with the data input. As the drum 5 rotates, the charge pattern on the drum surface is brought into contact with toner particles in the developer tank 6, and the toner particles adhere to the discharged area on the drum 5. At the transfer station 10, paper 1 is brought into intimate contact with the drum 5 and the toner particles on the drum 5 are drawn to the paper 1 by the transfer corona 8 which is a wire stretched behind the paper 1 and maintained at a constant voltage. The paper then carries the charged particle toner pattern on the paper web 1 over the dancer arm structure 20, across the preheat platen 45 and through the fuser station 40, where the toner is fixed by a combination of heat and pressure provided by heater roller 41 and pressure roller 42. Motor 43 drives heater roller 41. Pressure roller 42 is rotationally driven by frictional engagement with roller 41. Motor 43 has a code disc 44 which rotates with motor 43 and serves a purpose later described.

Note, that as before mentioned, the printing process disclosed with the presently preferred embodiment is not a part of the invention in that the invention is applicable to any web loop tension control system. The details of the xerographic printing process are, therefore, not further described to prevent unnecessary and undue length in description.

Figure 4:
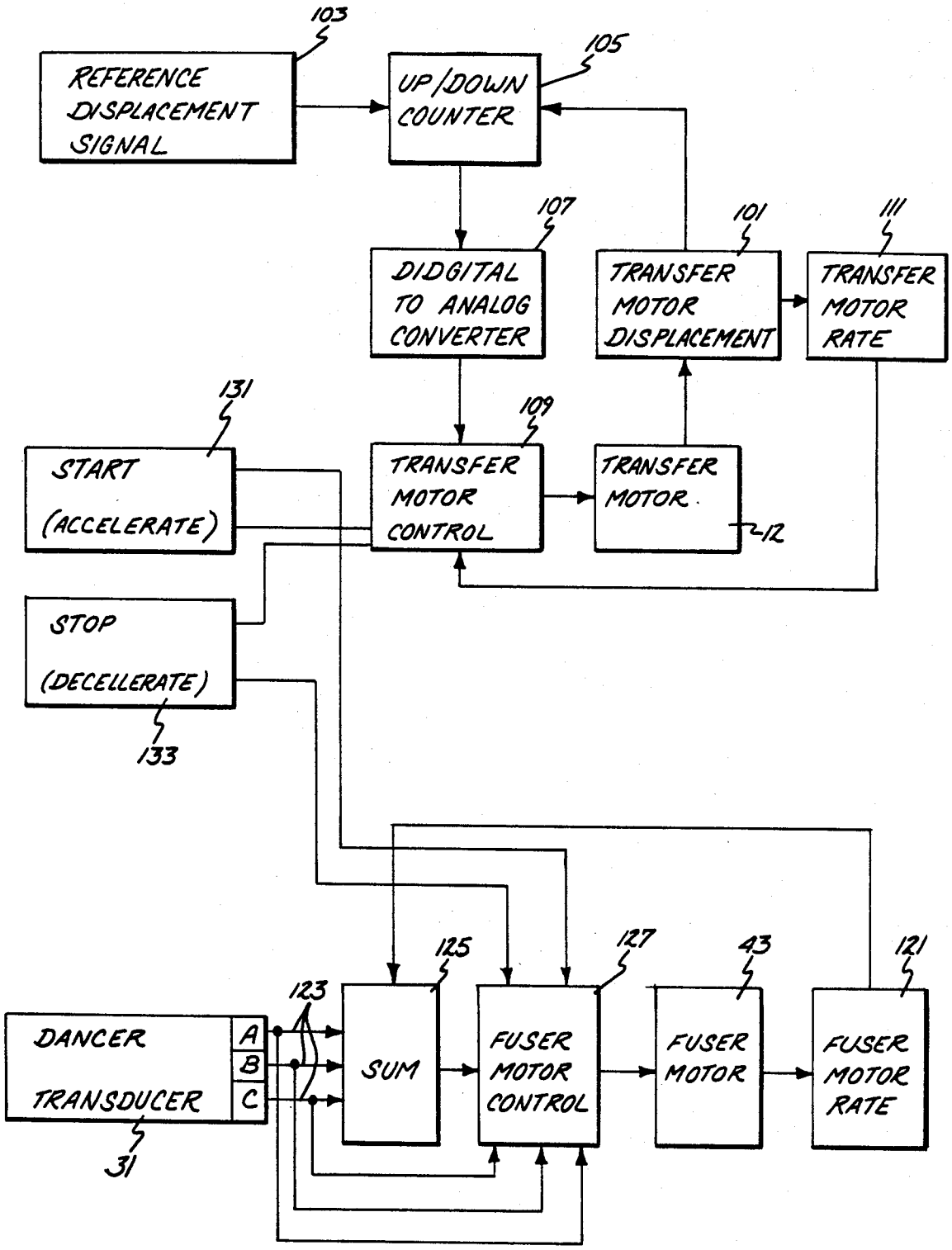
FIG. 4 is a block diagram of the system control for the present invention.

The transfer station 10 includes tractors 11 which are driven by a transfer station drive motor 12. The tractors 11 are equipped with drive pins (not shown) which engage margin perforations (not shown) in the web 1 in the conventional manner. The tractors 11 engage the paper 1 to move it through the transfer station 10. The transfer station drive motor 12 is controlled by a clocked, digital system which achieves a closely controlled constant paper displacement and velocity through the station. See FIG. 4. A code disk 13 is secured on the drive shaft of the motor 12. Code disk 13 is a sequential code disk having a series of transparent slits on its periphery. An optical reader 14 is used in conjunction with the code disk 13 to determine the displacement of the motor 12 in a conventional manner. With reference to FIG. 4, the motor displacement signal 101 from the code disk reader 14 is compared with the reference displacement signal 103 by an up/down counter 105. The reference displacement signal 103 counts the counter 105 up, and the motor displacement signal 101 counts the counter 105 down. If there is a discrepancy between the actual displacement and reference displacement, the up/down counter 105 will output a nonzero count. The nonzero count is fed into a digital to analog converter 107 which outputs a corresponding analog error signal to the transfer motor control 109. The transfer motor control 109 speeds up or slows down the transfer motor 12 to achieve and maintain a zero count at the up/down counter 105 by maintaining proper displacement by the transfer motor 12.

The reference displacement signal 103 is a series of clock pulses at a closely controlled frequency which are fed into the up/down counter 103 to count it up as mentioned. Similarily, the transfer motor displacement, or actual motor displacement, signal is produced by the transparent slits of the fuser motor code disk 13 which generates an output of a series of pulses which are fed into the up/down counter 105 to count it down. When the output of the up/down counter 105 is a zero count, the fuser motor code disk output 101 and the reference clock pulses 103 are in phase at the clock pulse frequency, producing the desired operating velocity and displacement for the motor 13 and web 1.

It is desirable to damp the rate of acceleration of the transfer station motor 13 when an error signal is produced by the D/A converter 107 to prevent system oscillations about the zero count point mentioned above. Where acceleration or deceleration of the transfer motor 13 in response to error signals is not damped, motor 13 will tend to alternatively overshoot and undershoot the zero count point producing an undesirable oscillation pattern. The present invention embodies a novel method of damping this oscillation pattern by extracting a transfer motor rate damping signal 111 from code disk 13, and summing this damping signal 111 with error signal from the D/A converter 107 at the transfer motor control 109. To generate this rate damping signal 111, a string of pulses produced by the slits of the disk 13 is also fed through a suitable filter (not shown) to generate a DC voltage proportional to the speed of motor 12. This DC rate signal 111 is combined with the analog error signal 107 in the motor control 109 to minimize oscillations about the zero count point and hereby provide smooth, steady control of the transfer motor 12.

To ensure continuous paper feed through the system, the fuser station 40 must be synchronized with the transfer station 10. If the stations 10 and 40 are not properly synchronized, and the fuser 40 is not keeping up with the transfer station 10, excessive slack will appear in the paper web loop 15 between the transfer and fuser stations 10, 40. Originally, the fuser control system was digitally synchronized with the transfer motor 12. Due to small dimensional variations in the diameters of the tractors 11, however, over a time interval, slack would accumulate between the stations, requiring a paper tension transducer to maintain substantially equal paper displacement rates between the transfer and fuser stations 10, 40.

In the present invention, paper tension is monitored by a spring loaded arm, or dancer structure 20, which follows the paper loop 15.

The dancer structure 20 comprises a rigid dancer arm 21, pivoted at point 22 to the upper end of the preheat platen 45 of the fuser station 40. A smooth hollow rod 23 for engaging the paper web loop 15 is disposed at the upper end 24 of dancer arm 21. A spring 25 is attached at one end 26 to the lower end 27 of dancer arm 21 and at the other end 28 to the preheat platen 45 to bias the dancer arm 21 in the counterclockwise direction in FIG. 2. A dancer arm code disk 30 is rigidly affixed to the dancer arm 21 and is centered on the pivot point 22 as shown. The dancer arm code disk 30 is best shown in FIG. 3. The disk is used in conjunction with an optical transducer structure 31, best shown in FIG. 3. The design of code disk 30 is dependent on the type of system in which the present invention is applied. In the presently preferred embodiment, the invention is used for the printing of serialized forms. In the printing of serialized forms, it is necessary that the length of the web loop 15, between the transfer and fuser stations 10, 40, be controlled to ensure that a whole number of forms is contained therein. The reason for this is later described. Since forms of various lengths must be accommodated, the length of web loop 15 must be varied for the different form lengths. As will later be described more fully, the inventor employs three different integral loop lengths to accommodate forms of all sizes. These lengths for the web loop 15 are designated A, B and C. It should be appreciated that the position of the dancer arm 21 will determine the length of web loop 15. Consequently, the dancer arm 21 has three "reference positions" to correspond to the three integral loop lengths A, B and C.

Given the need to accommodate the three different lengths A, B and C for the web loop 15, code disk 30 is designed with three "channels" 34, 35 and 36 which respectively correspond to the loop lengths A, B and C as will become apparent.

FIG. 2 shows the presently preferred embodiment of code disk 30. Each of the channels 34, 35 and 36 of disk 30 are comprised of opposed transparent, or translucent, channel sections 34*a* and 34*b*, 35*a* and 35*b*, and 36*a* and 36*b*. The channel sections 34*a*, 34*b*, 35*a*, 35*b*, 36*a* and 36*b* lie in concentric regions; with 34*a* lying in the innermost, or first, concentric region 50; 34*b* lying in the next, or second, concentric region 51; and so on with the channel section 36*b* lying in the outermost, or sixth, concentric region 55. There is no overlap between the concentric regions 50–55. Even the concentric regions of the opposing channel pairs are spaced and do not overlap. For example, the concentric regions 50 and 51 of the channel pair 34*a* and 34*b* are spaced and do not overlap. The same holds true for the concentric regions 52, 53 of channel pair 35*a*, 35*b*, and the concentric region 54, 55 of the channel pair 36*a*, 36*b*. Each of the channel sections has a tapering portion: channel section 34*a* has tapering portion 34*c*; section 34*b* has tapering portion 34*d*; section 35*a* has tapering portion 35*c*; and sections 35*b*, 36*a* and 36*b* have respective tapering portions 35*d*, 36*c* and 36*d*. Note that tapering portion 34*c* overlies tapering portion 34*d*, and that, likewise, portion 35*c* overlies portion 35*d*, and portion 36*c* overlies portion 36*d*. Each of the tapering portions extends approximately 5 degrees in arcuate length. Each of the channels 34–36 has a rotational center 37–39, respectively, which is located approximately at the arcuate centers of the tapering overlying portions 34*c* and 34*d*, 35*c* and 35*d*, and 36*c* and 36*d*. The alignment of these rotational centers 37–39 with the optical transducer 31 serve as reference positions for the code disk 30 and dancer 21 as will become apparent.

The transducer structure 31 is designed to cooperate with the code disk 30. With reference to FIG. 3, transducer 31 is comprised of optical transmitters 32*a*–32*f* and corresponding optical receivers 33a'–33*f*. These transmitters and receivers are disposed on opposite sides of code disk 30 so that light from the transmitters 32*a*–32*f* passes through the code disk 30 to be sensed by the receivers 33*a*–33*f*. The transmitters 32*a*–32*f* are fixed in position and are aligned with the corresponding optical receivers 33*a*–33*f* which are also fixed in position so that the rotation of disk 30 and the corresponding positions of the channel sections 34*a*, 34*b*, 35*a*, 35*b*, 36*a* and 36*d* determine the amount of light emitted from the optical transmitters 32*a*–32*f* which is received by the associated receivers 33*a*–33*f*. For example, in FIG. 3, full light is being received by receivers 33*b* and 33*f* from the associated transmitters 32*b* and 32*f* through the respective channels 34*b*, 36*b*; while a partial light signal is being received by receivers 33*c*, 33*d* from transmitters 32*c*, 32*d* via channel sections 35*a*, 35*b*; while no light is being received by receivers 33*a*, 33*c* from transmitters 32*a* and 32*e*.

Actually, only one pair of transmitters 32*a* and 32*b*, 32*c* and 32*d*, or 32*e* and 32*f*, and the associated pair of receivers 33*a* and 33*b*, 33*c* and 33*d*, or 33*e* and 33*f*, respectively, is utilized at any time depending on whether the operator selects web loop length A, B or C. For example, if the operator selects that the apparatus will operate with a desired loop length of A, transmitters 32*a*, 32*b* and receivers 33*a*, 33*b* would be activated and the transducer 31 would read channel 34. Likewise if loop length B is selected, transmitters 32*c*, 32*d* and receivers 33*c*, 33*d* are activated and transducer 31 reads channel 35. If loop length C is selected, transmitters 32*e*, 32*f* and receivers 33*e*, 33*f* are activated and transducer 31 reads channel 36.

The amount of light received through code disk 30 by the activated pair of receivers 33*a*, 33*b*; 33*c*, 33*d*; or 33*e*, 33*f* determines the output voltage of transducer 31.

Using receiver pair 33*a*, 33*b* as an example, which assumes that the operator has selected loop length A, the control system is so designed that the transducer 31 will have an output of zero volts when equal amounts of light are sensed by the receivers 33*a*, 33*b*. The output would be zero because the ouputs of receiver 33*a*, 33*b* would be equal but opposite in polarity, and therefore, would exactly cancel to zero when combined to produce the output of transducer 31. Code disk 30 is designed so that the tapering portions 34*c*, 34*d* will allow equal amounts of light to impinge upon receivers 33*a*, 33*b* at the rotational center 37 of the channel 34. Bearing in mind that the code disk 30 is fixed for rotation with dancer arm 21, the alignment of the rotational center 37 of channel 34 with the transmitters 32*a*, 32*b* and receivers 33*a*, 33*b* is the zero voltage point for both code disk 30 and dancer arm 21 and is therefore the "reference position" for arm 21 when the operator has selected an A loop length.

FIGS. 2 and 3 show the rotational center 38 of channel 35 aligned with the transmitters 32*c*, 32*d* and receivers 33*c*, 33*d* so that equal light impinges upon the receivers 33*c*, 33*d*, and the output of the transducer 31 would be zero volts if these receivers were activated. The code disk position shown in FIGS. 2 and 3 is, thus, the zero voltage, or reference, position, for code disk 30 and dancer arm 21 when a B web loop length is to be maintained. Likewise, if the operator selects a C loop length, the reference position of dancer arm 21 is the alignment of the rotational center 39 of channel 36 with the transmitters 32*e*, 32*f* and 33*e*, 33*f*.

If we again assume that loop length A has been selected, the length of web loop 15 will be A when dancer arm 21 is in its reference position 37. If web loop 15 varies from length A, arm 21 will be moved from this reference position 37 and transducer 31 will output a non-zero voltage signal. This non-zero voltage signal is an "error signal." The error signal is either positive or negative depending on which side of reference position 37 the arm 21 moves to. It has been noted that when loop A is selected, optical receiver 33*a* reads channel 34*a* and optical receiver 33*b* reads channel 34*b*. Receivers 33*a*, 33*b* produce output signals which are opposite in polarity and vary directly with the amount of light impinging on them. At reference point 37, equal amounts of light impinge on the receivers 33*a*, 33*b* and since these outputs are combined in transducer 31 the output of transducer 31 is zero volts. With reference to FIG. 2, however, assuming we start at this zero voltage position 31, if web loop 15 grows longer than length A, arm 21 and code disk 30 will rotate counterclockwise, and due to taper portions 34*c*, 34*d*, more light will impinge on receiver 33*a* than on receiver 33*b*. If we assume 33*a* is negative and 33*b* is positive, a negative error signal voltage will be produced by transducer 31 and be transmitted to the fuser motor control system (later described) to speed up the fuser motor 43 to shorten web loop 15 and bring the code disk back to the reference position 37. As the code disk 30 rotates counterclockwise from reference position 37, the broadening taper of portion 34*c*, and the narrowing taper of position 34*d*, produce a negative output signal from transducer 31 which increases in a linear fashion. If disk 30 rotates counterclockwise beyond taper positions 34*c* and 34*d*, full light will impinge upon receiver 33*a* while no light will impinge on receiver 33*b*. The output of transducer 31 will be a maximum voltage negative signal along this untapered position of channel section 34*a*. Once this maximum voltage level is reached the transducer 31 output will remain constant with increasing counterclockwise rotation of the disk 30 and dancer arm 21. Hence, when dancer arm 21 is displaced counterclockwise from its reference position 37, transducer 31 will generate a negative error signal increasing linearly along the taper regions 34*c*, 34*d* and then remaining constant at the "full signal" maximum voltage value beyond taper positions 34*c*, 34*d*. In a directly analagous manner, the displacement of dancer arm 21 clockwise from reference position 37 due to the shortening of loop 15 will be indicated by transducer 31 as a linearly increasing positive voltage signal along taper positions 34*c*, 34*d*, followed by a steady positive full signal maximum voltage value along the remainder of channel section 34*b*.

If loop length B were selected, rotational center 38 of channel 35 would be the zero voltage reference position of arm 21 and disk 30, and displacement to either side will be indicated by transducer 31 as a positive or negative error signal increasing linearly along taper positions 35*c*, 35*d* and then remaining constant at the full signal maximum voltage value with continued displacement from the reference position 38. If loop length C were chosen, the reference position of arm 21 would be the rotational center 39 of channel 36 and displacement away from reference position 39 would be indicated by transducer 31 as a positive or negative error signal linearly increasing along taper positions 36*c*, 36*d* and remaining constant at the full signal maximum voltage values beyond the taper positions 36*c*, 36*d*.

This bipolar error signal from the transducer 31 can be used to override the fuser digital control (earlier mentioned) to speed up or slow down the fuser motor 43 as desired to return the dancer arm 21 to its reference position 37, 38 or 39 wherein the desired web loop A, B or C length is achieved.

In the present embodiment, however, the fuser digital control is eliminated and replaced by the combination of a rate damping signal generated from the fuser motor 43 and the error signal from the dancer arm code disk transducer 31.

As shown in FIG. 1, a fuser motor code disk 44 is provided to rotate with the fuser motor 43. An optical transducer 46 is used with the code disk 44 to produce a signal representative of the velocity of the fuser motor 43. Code disk 44 is a sequential code disk (like code disk 13) having a series of transparent slits in its periphery. The rotation of the slits of code disk 44 past the transducer 46 produces a series of pulses which are sent through a suitable filter to produce a DC voltage which is proportional to the rotational speed of motor 43. This rate signal 121 (see FIG. 4) from fuser motor optical transducer 46 is summed with the output 123 of the dancer arm optical transducer 31 to provide a control signal 125 to the fuser motor control 127 which adjusts the speed of the motor 43 as necessary to return the dancer arm 21 to its reference position 37, 38 or 39. The rate signal 121 from the fuser motor optical transducer 46 serves as a rate dampening signal in that when it is combined with the dancer arm transducer signal 123, stable acceleration and deceleration of the fuser motor 43, and rollers 41, 42 can be achieved. The motor 43 is a high powered motor and because of the mass and rotational momentum of the rollers 41, 42, stability of the control of motor 43 is essential. The dancer arm optical transducer 31 is a low power signal source which causes changes in the high power fuser motor 43 corresponding to its position with respect to reference positions 37, 38 and 39. If no rate damping signal were provided, a very fast change in the position of the dancer arm 21 would correspondingly cause a very fast change in the speed of the fuser motor 43. Due to the high powered nature of the fuser motor 43 and the rotational momentum, mass, etc. of rollers 41, 42, however, a very fast change in speed of motor 43 would cause the motor 43 to become unstable and severe oscillations would be generated. The novel rate damping signal 121 provided by the optical transducer 46 solves this oscillation problem by damping the rate of change of speed of the fuser motor 43 and rollers 41, 42 in response to the dancer arm error signal 123. Dancer arm 21 is, thus, returned to its reference position 37, 38 or 39 in a stable and controlled fashion. In the past such rate damping has been done by rate signals produced from electromechanical tachometer generators. The present invention eliminates such electromechanical devices in favor of the optical/electronic means disclosed and thereby avoids the many problems of the prior art method hereinbefore delineated.

Note that an optical/electronic rate damping signal 111 as also employed in the control of the transfer motor 12 has been formerly described. Thus, the optical, electronic method of motor control employed by the present invention is useful for virtually any motor control systems which relies upon error signal generation and feedback for motor control. The error signal may indicate a displacement error condition or a speed error condition. Whatever the type of error condition, the error is generated by a comparison of an actual condition with a reference condition. A descrepency between the actual and reference conditions give rise to the error signal and the optical/electronic rate damping signal of the present invention can be combined with this error signal to produce smoothly damped motor control.

It was previously described that toner is deposited on the paper web 1 by the transfer station 10 and is "fixed" by the fuser station 40. In the web loop 15 between the transfer station 10 and the fuser station 40, the toner is held to the paper 1 by an electrostatic force. If the system is stopped for any appreciable period of time, the electrostatic force begins to decay and the toner, thus, becomes more loosely held to the paper 1. If, therefore, once the system is started up, excessive acceleration forces are applied to the web 1, the toner particles will become displaced. Assuming the system is stopped with the dancer 21 in its proper reference position 37, 38 or 39, if the transfer motor 12 is started, under the system so far described, the fuser station 40 will not start to accelerate from rest until an error signal is transmitted from the dancer arm 21. With the transfer station 10 first starting and the fuser station 40 at rest, slack will develop in the web loop 15 and this slack will be sensed by the dancer arm 21 causing an appropriate error signal to be sent to the fuser station 40 to start it up. If, however, the fuser station 40 does not start to accelerate until a signal is received from the dancer arm transducer 31, there is a possibility that the inertia of the dancer arm 21 will cause it to lag behind the paper loop 15. As the fuser drive motor 43 accelerates, the paper 1 may then be pulled down against the accelerating dancer arm 21, causing a substantial impact and possible displacement of the toner.

To prevent this fuser motor start delay and to minimize acceleration forces, the control system, shown schematically in FIG. 4, includes acceleration and deceleration cycles 131, 133 during which the transfer and fuser motors 12, 43 are simultaneously accelerated at the same rate up to operating velocity or simultaneously decelerated from operating velocity to rest.

There are two commonly used sources of controlled motor feedback. One is a "voltage mode" in which the source of controlled motor feedback is the tachometer voltage from a transducer system attached to the motor shaft. The other is a current mode in which the source of controlled motor feedback is motor current from a shunt in series with the motor windings. In the voltage mode, the voltage is proportional to motor velocity. In the current mode the current is proportional to motor torque. Voltage control is more common, and tends to be more stable, providing better motor speed control. However, voltage control places no limits on acceleration during transient operation. To produce high performance, incremental motion and still control acceleration, a "constant current" drive may be employed. The constant current drive of the current mode results in a relatively constant, controlled torque and, hence, a controlled acceleration.

In the present system, therefore, the motors are in a voltage mode while in the general operating, or drive, condition, and are switched into a current mode during acceleration and deceleration modes to and from zero velocity.

As can be appreciated by reference to FIG. 4, during the drive mode, or voltage mode, the system is closed loop in that the fuser motor 43 is controlled by feedback from the dancer arm 21 and the transfer motor 12 is maintained at the proper speed by the error signal 107. In changing to the current mode condition, however, both the transfer and fuser motors 12, 43 are switched from these closed loops to secondary feedback loops wherein constant current through the motors 12, 43 is maintained. The motors 12, 43 are, thus, controlled independently during this current mode to simultaneously accelerate or decelerate at the same rate. In addition to smoothing jarring and acceleration, the constant current mode provides finely controlled torque which allows for acceleration and decceleration within a $\frac{3}{8}$" limitation, meeting system requirements.

There is a final variation on the above described deceleration mode. If the system is in the drive mode and is switched into the deceleration mode, the transfer station motor 12 will decelerate from operating speed to a dead stop under the constant current, constant deceleration, condition. The fuser station motor 43, however, will decelerate from operating velocity to stop and will then be switched back into the closed loop velocity mode so that the dancer arm transducer 31 can control the final stopping point of the fuser motor 43 to ensure that the dancer arm 21 rests at its reference position 37, 38 or 39 during the stop mode.

As an alternate embodiment, rather than maintaining the web loop at the desired length A, B or C during the drive mode, dancer arm 21 can be biased to a reference position at a slightly steeper angle than the rotational center reference position 37, 38 or 39. This can be achieved by imposing a bias voltage on the transducer 31. The bias voltage will move the "zero voltage" position away from the rotational center of the channel to cause the dancer 21 to run at a steeper angle during the drive mode. By causing the dancer 21 to run at a steeper angle, the fuser station 40 will not overshoot the stop position in that the rollers 41, 42 can be made to stop initially about $\frac{1}{2}$ inch or so before the between-form perforation. After the initial stop, the bias voltage is removed, causing transducer 31 to generate an error signal which causes the fuser station 41, 42 to roll slowly to the final stop position. This alternate embodiment is especially beneficial in systems where there would be great difficulty in backing up the fuser station rollers 41, 42, were the system to overshoot.

By ensuring that the dancer arm rests at the chosen reference position 37, 38 or 39 during the stop mode, the system ensures that the paper loop comprises an integral number of forms with both the fuser and transfer stations 10, 40 being stopped at between-form perforations. In printing systems such as the one employed in the present invention, the software programming typically dictates that the transfer station 10, after receiving a stop command, will complete the form in progress and then stop at the perforation between the bottom of the last form and the top of the next form. The transfer station 10, thus, always stop at a between-forms perforation. It is also important that the paper 1 stop at a between-forms perforation at the fuser roller station 40 in that if the paper 1 is stopped with a printed portion of a form at the "nip" or interference area between the pressure roller 42 and the heater roller 41, the toner on the paper 1 will become overheated and smear. Consequently, to ensure that the paper web flow stops with a perforation at the nip, the length of paper loop 15 from the perforation at the transfer station 10 to the nip at the fuser station 40 must comprise an integral, or whole, number of forms. Where the number of forms between the transfer station 10 and the fuser station 40 is an integer, a between-forms perforation will be stopped at the nip. There is a wide variety of foreign and domestic forms, of various lengths, which are printed in machines such as that employed in the present invention. Given the approximate web loop distance between the transfer station 10 and the fuser station 40, however, a number of integral web loop lengths can be determined which will accommodate all of the various forms. In the embodiment presently disclosed, it was determined that all the desired forms could be accommodated by three integral loop lengths which have been designated A, B and C as noted above.

In operating the system, the operator selects the desired loop length, A, B or C, which will accommodate the form to be printed. By selecting the loop length, the operator also selects which of the channel 34, 35 or 36 will be read by the optical transducer 31. Here, for example, if the operator selects loop length B, the optical transducer 31 will read only channel 35 of the code disk 30. As discussed above, the rotational center 38 of the channel 35 is a reference position or zero voltage position for disk 30 and dancer arm 21. If loop length B is selected, therefore, the reference position of the dancer arm 21 is the position wherein the optical transducer 31 is centered on the rotational center 38 of channel 35. Given the above arrangement, if the operator has selected a B loop length, and the sysem is in the drive mode with the paper 1 at operating velocity, dancer arm 21 and transducer 31 will maintain a B loop length between transfer station 10 and fuser station 40 by sending an error signal to the fuser motor 43 whenever the dancer arm 21 moves to either side of its reference position 38. The optical/electronic rate damping signals ensure that error correcting by the motor control systems 109, 127 is smooth and stable.

With the system at operating velocity, and dancer arm 21 maintaining a B loop length, when a stop, or decelerate command is entered, the system is switched from the velocity control mode to the deceleration control current mode, wherein the transfer and fuser motors 12, 43 simultaneously decelerate at the same rate, with the fuser motor 43 being swiched at stop back into the closed loop voltage mode so that the dancer arm 21 can make any final adjustments necessary to ensure that a B loop length is provided between the transfer station 10 and fuser station 40. Given the fact that the transfer station 10 has stopped at a perforation, and the loop length 15 is the integral length of B, the paper web 1 has been stopped so that a between-forms perforation is at the nip of the fuser station 40.

Having described the preferred embodiment of the present invention, and the various important aspects, many modifications and variations thereof would be possible in view of its teachings. It is intended to be understood, therefore, that the invention is to be limited only by the scope of the appended claims.

I claim:

1. A web loop control system for a web feeding apparatus, having a first roller means engaged with said web; a second roller means engaged with said web having a drive means and a drive means control; and a dancer member pivotally supported on said apparatus operationally intermediate said first roller means and said second roller means, said dancer member rotatably supporting a dancer roller, said dancer roller being biased into engagement with said web, said web sequentially passing from said first roller means to said dancer roller to said second roller means and being disposed in a web loop between said first roller means and said second roller means, said dancer member pivoting to follow said web loop as the length of said web loop varies, the improvement comprising:

a code disk secured for rotation with said dancer arm, and an optical transmitting means and an optical receiving means, said optical transmitting means transmitting light towards said code disk, the rotational position of said code disk determining the light received by said optical receiver from said optical transmitter, said optical receiver generating said dancer arm position information in response to the light received, said dancer arm position information being transmitted to said second roller means motor control means to adjust said drive means for said second roller means as necessary to achieve a desired length for said web loop.

2. The web loop control system of claim 1, wherein said code disk includes a light-permeable portion and an opaque portion, and wherein said optical transmitter and said optical receiver are disposed on opposite sides of said code disk, said optical transmitter projecting light through said light permeable portion towards said optical receiver.

3. The web loop control system of claim 2, wherein said light-permeable portion of said code disk has a tapered segment.

4. The web loop control system of claim 3, wherein said optical receiver generates a dancer arm position signal which is linearly related to dancer arm angular displacement while said tapered segment of said light permeable portion is rotating past said optical receiver.

5. The web loop control system of claim 2, wherein said channel is comprised of oppositely disposed accurate first and second channel sections, said first channel section being disposed in a first concentric region, said second channel section being disposed in a second concentric region; and wherein said optical sensing means is comprised of a first and a second optical transmitter and a first and a second optical receiver, said first optical transmitter and said first optical receiver being aligned with said first channel section on opposite sides of said code disk, and said second optical transmitter and said second optical receiver being aligned with said second channel section on opposite sides of said code disk, said first transmitter and said first receiver being operable to read said first channel section, said second transmitter and said second receiver being operable to read said second channel section.

6. The web loop control system of claim 5, wherein said first channel section has a first tapered portion, and said second channel section has a second tapered portion, said first and said second tapered portions being tapered in opposite directions and being disposed in an overlying relationship.

7. The web loop control system of claim 6 wherein said overlying tapered portions have a rotational center; and wherein said first and second optical receivers produce respective outputs which vary directly with the amount of light received through said respective first and second channel sections, said outputs being equal in magnitude when said first and second receivers are aligned with said rotational center, one of said outputs being negative and the other of said outputs being positive, said outputs being summed by said optical sensing means, the sum of said outputs at said rotational center being zero, said code disk and said dancer arm being in a zero voltage reference position when said rotational center of said channel is aligned with said receivers and said transmitters.

8. The web loop control system claim 7 wherein said optical sensing means produces a negative error signal when said code disk and said dancer arm are rotated to one side of said zero voltage reference position and produces a positive error signal when rotated to the other side of said zero voltage reference position.

9. The web loop control system of claim 8 wherein said negative error signal increases linearly as said code disk and said dancer arm rotate to one side of said rotational center, and wherein said positive error signal increases linearly as said dancer arm rotates to the other side of said rotational center.

10. The web loop control system of claim 1, further comprising a second roller drive means rate sensing means, said rate sensing means generating a signal proportional to the rate of said drive means, said rate signal being summed with said position information signal from said optical receiver and input into said control means to control said second roller drive means.

11. The web loop control system of claim 10, wherein said first roller means has a first roller drive means and first roller drive means control, said first roller drive means and said second roller drive means having a drive mode, an accelerate mode, and a decelerate mode; said first roller drive means being driven at a constant speed and moving said web at a constant speed during said drive mode, said second roller drive means being driven at a substantially constant speed by said rate signal and said position information signal during said drive mode; said dancer arm having a first reference position when said web loop length is said first length; said first roller drive means being decelerated at a first rate from said constant speed to a dead stop position; said second roller drive means being decelerated at said first rate from said substantially constant speed to a stop position and then driven by said rate signal and said position information signal to a dead stop position where said dancer arm assumes said first reference position so that said web loop length is said first length.

12. The web loop control system of claim 1, wherein said desired length for said web loop is a first length, and wherein said dancer arm is in a first reference position when said web loop length is said first length.

13. The web loop control system of claim 1, wherein said code disk has a first channel, a second channel, and a third channel, and wherein said dancer arm has a first reference position corresponding to a first web loop length, a second reference position corresponding to a second web loop length, and a third reference position corresponding to a third web loop length, said optical sensing means reading said first channel when said first web loop length is selected, said second channel when said second web loop length is selected, and said third channel when said third web loop length is selected.

14. The web loop control system of claim 13 wherein said optical sensing means generates positive position information when said dancer arm is pivoted to one side of said first, second or third reference positions, and negative position information when said dancer arm is pivoted to the other side of said first, second or third reference positions.

15. The web loop control system of claim 14 wherein said first channel has a first rotational center, said second channel has a second rotational center, and said third channel has a third rotational center; and wherein said first rotational center of said first channel is aligned with said optical sensing means when said dancer arm is in said first reference position; said second rotational center of said second channel is aligned with said optical sensing means when said dancer arm is in said second reference position, and said third rotational center of said third channel is aligned with said optical sensing means when said dancer arm is in said third reference position.

16. In a web loop control system for a web feeding apparatus, having a first roller means engaged with said web; a second roller means engaged with said web having a drive means and a drive means control, and a dancer member pivotally supported on said apparatus operationally intermediate said first roller means and said second roller means, said dancer member rotably supporting a smooth dancer rod, said dancer rod being biased into engagement with said web, said web sequentially passing from said first roller means to said dancer rod to said second roller means and being disposed in a web loop between said first roller means and said second roller means, said dancer member pivoting to follow said web loop as the length of said web loop varies, a method of maintaining a desired length for said web loop during web flow conditions, comprising the steps of:

optically sensing the position of said dancer arm with a code disk secured for rotation with said dancer arm and an optical transmitting means which directs light towards the code disk and an optical receiving means, the rotational position of said code disk determining the light received by said optical receiver from said optical transmitter, said optical receiver generating said dancer arm position information in response to the light received;

transmitting said position information to said drive means control; and adjusting said drive means for said second roller means in response to said position information as necessary to achieve a desired length for said web loop.

17. In a web loop control system for a web feeding apparatus, having a first roller means engaged with said web; a second roller means engaged with said web having a drive means and a drive means control, and a dancer member pivotally supported on said apparatus operationally intermediate said first roller means and said second roller means, said dancer member rotably supporting a smooth dancer rod, said dancer rod being biased into engagement with said web, said web sequentially passing from said first roller means to said dancer rod to said second roller means and being disposed in a web loop between said first roller means and said second roller means, said dancer member pivoting to follow said web loop as the length of said web loop varies, a method of maintaining a desired length for said web loop during web flow conditions, comprising the steps of:

providing a code disk secured for rotation with said dancer arm, and an optical transmitting means and an optical receiving means, determining the light received by said optical receiver from said optical transmitter according to the rotational position of said code disk;

transmitting said position information to said drive means control; and adjusting said drive means for said second roller means in response to said position information as necessary to achieve a desired length for said web loop.

* * * * *